United States Patent [19]

Dreizler

[11] Patent Number: 4,589,244

[45] Date of Patent: May 20, 1986

[54] SPACER FOR REINFORCEMENT MATS

[76] Inventor: Selma Dreizler, Ringstr. 81, 7066 Baltmannsweiler 2, Fed. Rep. of Germany

[21] Appl. No.: 483,056

[22] Filed: Apr. 7, 1983

[51] Int. Cl.[4] ..... E04C 5/16

[52] U.S. Cl. ..... 52/685; 52/686; 52/719; 403/399

[58] Field of Search ..... 52/684, 685, 686, 719, 52/677, 688, 689; 403/389, 399, 400

[56] References Cited

U.S. PATENT DOCUMENTS 3,916,593 11/1975 Skold ..... 52/686

FOREIGN PATENT DOCUMENTS 7732466 10/1977 Fed. Rep. of Germany ..... 52/684
319475 7/1934 Italy ..... 403/400
778874 7/1957 United Kingdom ..... 403/399

*Primary Examiner*—Carl D. Friedman
*Assistant Examiner*—Naoko N. Slack
*Attorney, Agent, or Firm*—Martin A. Farber

[57] ABSTRACT

A spacer for reinforcement mats in a framework has a spacer bar to which there is fastened at least one double-leg clamp the legs of which define an edge-open opening of substantially U shape which is adapted to the cross-sectional dimensions of a bar of a reinforcement mat, the opening having associated with it a spring barrier which closes the opening and holds the clamp in non-detachable manner on the bar of the reinforcement mat.

In order to design the spacer for larger stresses while still assuring simple possibilities of manufacture the clamp (3) is developed in the form of a flat plate (5) which is fastened in the region of the bottom of the U-shaped opening (6) to the spacer bar (1) and the barrier is formed by a spring element (11, 11*a*, 11*b*, 11*c*) which is anchored to one leg (7, 8), extends into the opening (6) and can elastically be moved away laterally towards the leg.

25 Claims, 7 Drawing Figures

SPACER FOR REINFORCEMENT MATS

BACKGROUND OF THE INVENTION

The present invention relates to a spacer for reinforcement mats within a framework, having a spacer bar to which there is fastened at least one double-leg clamp whose legs define a substantially U-shaped opening adapted to the cross-sectional dimensions of a bar of a reinforcement mat, said opening having associated with it a spring barrier which closes the opening and holds the clamp in non-detachable manner on the bar of the reinforcement mat.

Such spacers are used, for instance, in vertical reinforcements to hold two reinforcement mats a predetermined distance apart and at the same time make certain that the reinforcement mats in their turn are at the correct distance from the form boards. In an embodiment known from West German Utility Model No. GM 7 732 466, two clamps are fastened at a predetermined distance from the two ends on the spacer bar which bears plastic caps at its ends, said clamps being formed by bending spring wire into substantially U shape. The spacer is placed with these clamps on corresponding bars of the two reinforcement mats which are to be held spaced apart; in order to hold it in non-detachable manner the ends of the wire clamps are bent inwards so that a spring barrier is obtained which closes the opening which is defined by the two legs of a clamp.

These spacers have proven excellent in practice but their load-carrying capacity is limited since the legs of the wire clamps may be bent open under the action of larger forces, which can be prevented only to a limited extent even by increasing the diameter of the wire, which in any event would be possible only to a certain degree. Furthermore, the wire clamps, which consist of spring steel, are fastened by spot welding to the spacer bar which is formed from simple, cheap, unalloyed carbon or structural steel. Such a rational weld connection is, however, possible only up to a certain diameter of the wire material of the clamps. More expensive methods of welding, however, cannot be used, if only for the reason that spacers are mass-production articles which must be manufactured at low cost.

SUMMARY OF THE INVENTION

The object of the invention is, therefore, to provide a spacer which, while it can be manufactured in an inexpensive and rational manner, is adapted to take up even relatively large forces acting on the clamps without the handling being impaired thereby.

In order to achieve this object, the afore-mentioned spacer is characterized, in accordance with the invention, by the fact that the clamp is developed in the shape of a flat plate which is fastened to the spacer bar in the region of the bottom of the U-shaped opening and that the barrier is formed by a spring element which is anchored to one leg, extends into the opening, and can be elastically pressed away laterally towards the leg.

By developing the clamp as a flat plate, the clamp can be produced at low cost as a simple stamped part. If its dimensions are suitable, such a plate is extremely stable, so that the legs which define its U-shaped opening cannot be pressed towards the side even under the action of relatively large forces. The plate and the spacer bar consist, as a rule, of simple unalloyed carbon steel or structural steel, the plate being welded to the spacer bar. In this way, there is obtained a relatively large welding surface as compared, for instance, with a wire strap, this in its turn leading to a very stable weld attachment without special measures having to be taken for this. Furthermore, the welding conditions for attaching the spacer bar to the plate, which consists essentially of the same material, are substantially more favorable than in the case of the welding of a spring-steel strap to a spacer bar of unalloyed carbon steel or structural steel.

In one preferred embodiment, the spring element is an elastically movable spring tongue which is anchored at one end to the leg and the free end of which extends into the opening, thus preventing unintentional removal of the clamp from the associated reinforcing bar. In this connection, the free end of the spring tongue which is directed obliquely towards the bottom of the U-shaped opening can be supported on the opposite leg so that a form-locked locking of the opening is obtained. For the same reason, the arrangement may also be such that the free end of the spring tongue can be supported on a projection on the other leg.

In principle, the spring tongue can be formed by a leaf spring but it is also possible to develop it in the form of a wire spring. This second embodiment is cheaper and enters into consideration in particular for spacers which are intended for reinforcement bars of large diameter.

In a further embodiment, the spring tongue can be formed by cutting from a piece of spring plate which is fastened by holding parts developed thereon to the corresponding leg of the clamp. Structurally simple conditions are obtained, however, also if a correspondingly shaped end part of the spring tongue is anchored in non-detachable manner, and bendable in one direction, within a holding opening in the associated leg and if the spring tongue is fixed in its position laterally by material of the plate.

In order to assure a particularly accurate seat of the spacer on the reinforcement bars, the spring tongue may have a holding part which is bent towards the bottom of the U-shaped opening and holds a reinforcement bar resting against the bottom of the opening. In a further embodiment, this can be achieved in the manner that the spring tongue is formed by a side part of a strip of spring material bent into approximately triangular shape, the base part of which is inserted into a holding opening in the associated leg which surrounds it on both sides and the other side part of which is the holding part.

Particularly when using a spring tongue consisting of round wire it is advantageous for the plate to consist of two interconnected mirror-image plate parts which rest with their broad sides on top of each other and between which the spring tongue is held, said plate parts defining, within the region of the leg associated with the spring tongue, a niche-like recess which faces the U-shaped opening and receives the laterally bent spring tongue.

A spacer will, as a rule, bear two clamps having the shape of plates of the aforementioned type, each of which is arranged at a predetermined distance from its ends. However, cases are also conceivable in which only a single clamp is arranged on the spacer bar, for instance at its center. As already mentioned, the plates themselves are, as a rule, preferably made of an unalloyed, simple carbon steel or structural steel.

BRIEF DESCRIPTION OF THE DRAWINGS

Various embodiments of the subject matter of the invention are shown in the drawing, in which.

DESCRIPTION OF THE PREFERRED EMBODIMENTS

Figure 1:
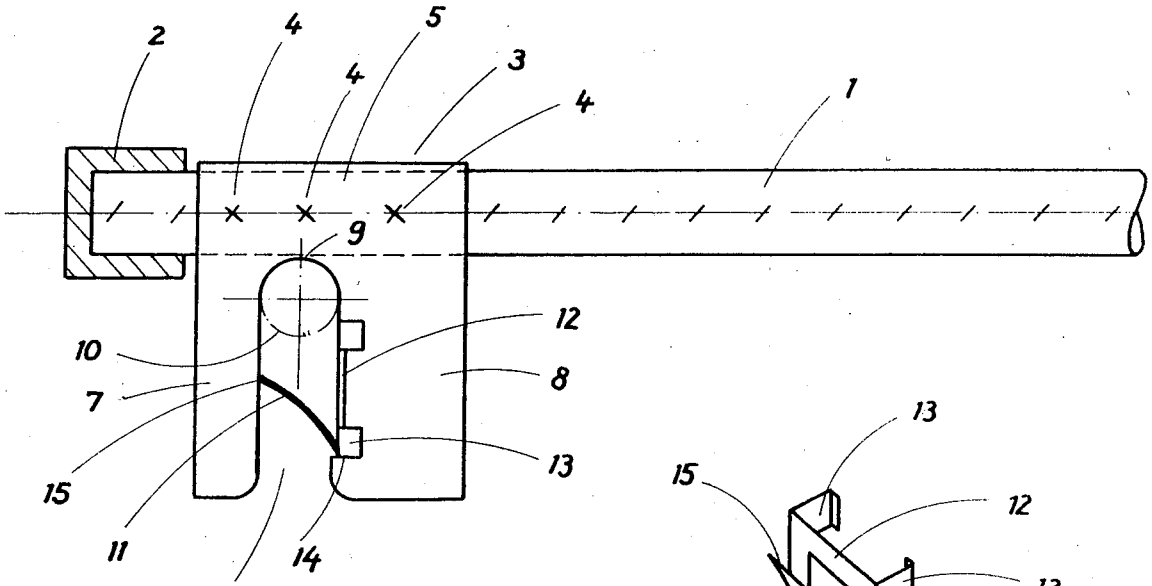
FIG. 1 shows a part of a spacer according to the invention in a first embodiment, seen in side view, partially in cross section.

The spacer various embodiments of which are shown in the figures in each case has a cylindrical spacer bar 1 which consists of an unalloyed carbon steel and bears at each of its two ends a cap of plastic or material having an affinity for cement, shown in cross section at 2, two clamps 3 being fastened to said bar 1 at a predetermined distance from its respective ends, only one of said clamps, however, being shown, for the sake of simplicity, in FIGS. 1, 3, 5, 6 and 7.

Each of the clamps 3 is made in all embodiments in the form of a flat plate 5 from an unalloyed carbon steel. The plate 5 is welded to the spacer bar with its wide side resting against it. The spot welds are indicated at 4 (FIG. 1).

Each plate 5 has a substantially U-shaped opening 6 which is defined by two legs 7, 8 of the plate 5 and a base or bottom 9 of which is curved corresponding to the diameter of a reinforcement bar, indicated in dashed line at 10, the corresponding clamp 3 of the spacer being placed on said bar. The U-shaped opening 6 has, associated with it, a spring barrier which prevents the unintentional loosening of the clamp 3 from the reinforcement bar 10.

Figure 2:
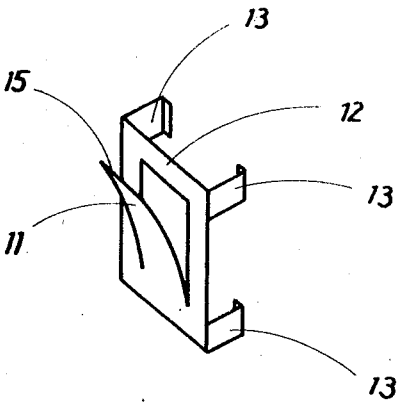
FIG. 2 shows in perspective a spring-plate part of the spacer of FIG. 1.

In the embodiment shown in FIG. 1, this barrier is formed by a spring tongue 11 which is bent out from an approximately rectangular spring plate part 12 shown in FIG. 2. The spring-plate part 2 bears holding claws 13 bent off laterally; it is placed in the manner shown in FIG. 1 on the inside of the leg 8 of the plate 5 and is held by the holding claws 13 which engage into corresponding cutouts in the plate 5, it resting axially on a shoulder 14 on the leg 8.

As can be noted from FIG. 1, the spring tongue 11 extends from the vicinity of the end of the leg 8, directed obliquely towards the bottom 9 of the U-shaped opening 6, into said opening, its free end resting—at 15—against the opposite leg 7.

When placing the clamp 3 on the reinforcement bar 10, the spring tongue 11, which is held for elastic movement at its anchoring point on the leg 8, can thus move out laterally towards the leg 8; as soon as the reinforcement bar 10 approaches the position shown in FIG. 1, the spring tongue 11 snaps back into the position shown in that figure, in which postion the U-shaped opening 6 is locked. Since the spring tongue 11 rests on the leg 7 at 15, as has been mentioned, a form-locked barrier is provided for the opening 6; the spring tongue 11 can take up considerable forces in the blocking direction.

Figures 3, 4:
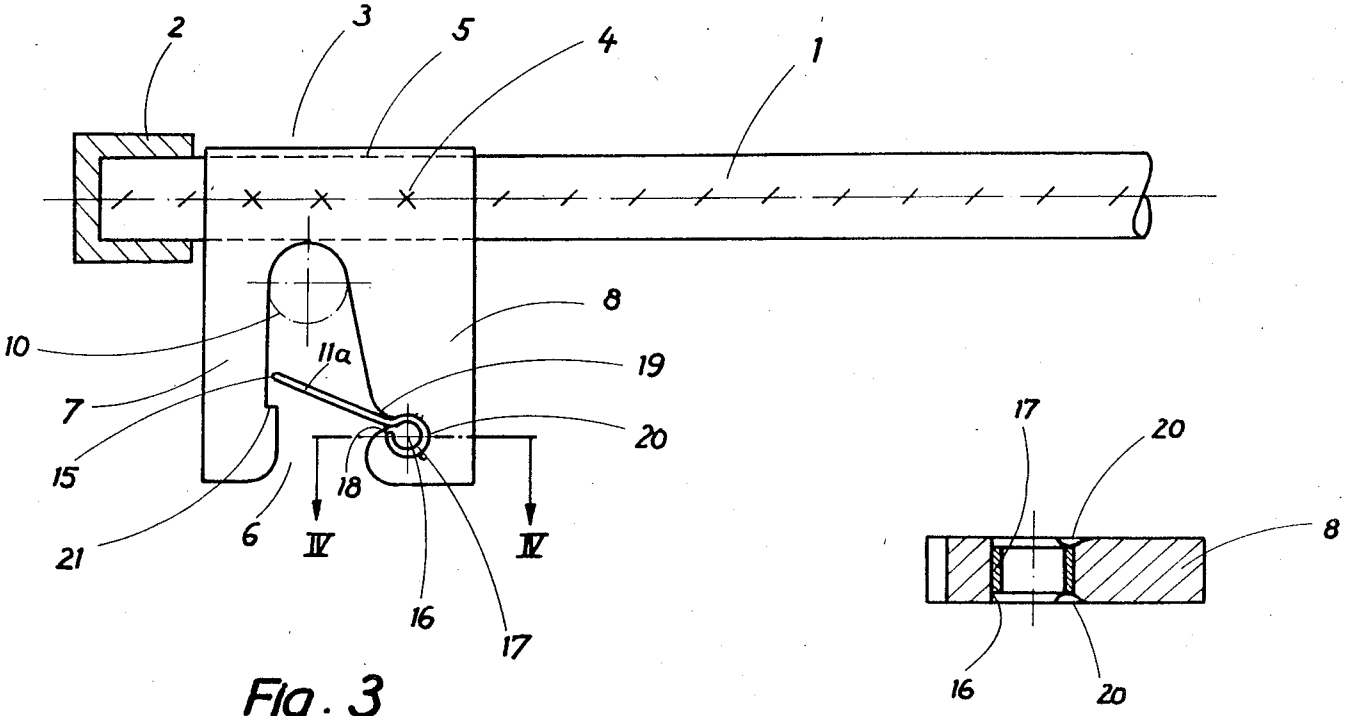
FIG. 3 shows a second embodiment of a spacer in accordance with the invention, in a showing corresponding to FIG. 1 in side view.
FIG. 4 shows a detail of the clamp of the spacer of FIG. 3, along the line IV—IV of FIG. 3, seen in top view.

In the embodiment shown in FIGS. 3 and 4, the arrangement is such that the leg 8 of the plate 5 is provided in the vicinity of its end with a continuous hole 16 into which the cylindrically rolled end portion 17 of the spring tongue **11*a*, which is also developed as a leaf spring, is inserted, the spring tongue 11*a* itself extending through a slot 18 into the U-shaped opening 6. The edge of the slot is rounded at 19 so that the spring tongue 11*a* can move away laterally in the direction of introduction of the reinforcement bar 10 (in clockwise direction in FIG. 3). In order to hold the end portion 17 of the spring tongue 11*a* in non-detachable manner in the hole 16, indentations 20 are provided in the leg 8 so that the spring tongue 11*a* is axially held in place by the material of the plate 5**.

On the opposite leg 7 there is developed a nose 21 onto which the end 15 of the spring tongue **11*a* can come to rest in blocking direction so that the U-shaped opening 6 is closed in the manner already described and the clamps 3 are held in non-detachable manner on the reinforcement bar 10**.

Figure 5:
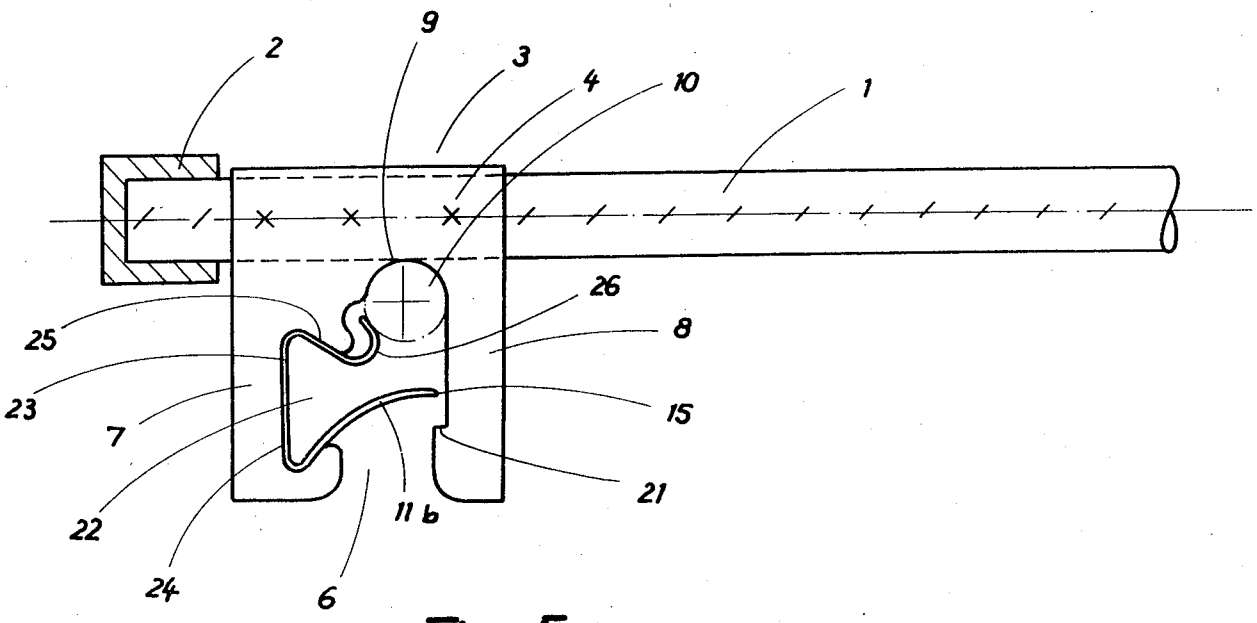
FIG. 5 shows a spacer in accordance with the invention in a third embodiment in a showing coresponding to FIG. 1 as well as in a side view.

In the embodiment shown in FIG. 5, the arrangement is such that the spring element 22, which is developed as leaf spring, is bent into approximately triangular shape from a strip of spring steel. The one side part **11*b* of the strip 22 of spring material forms the spring tongue which extends into the U-shaped opening 6 and rests at its free end 15 in blocking direction on a nose 21 on the leg 8. The base part 23 of the triangularly bent strip 22 of spring material is inserted into a corresponding holding opening 24, also approximately triangular in profile, which opens towards the U-shaped opening 6, the opening 24 extending laterally around the base part 23 in the manner which can be noted from FIG. 5. The other side part 25 of the strip 22 of spring material is bent to form a semi-circular holding part 26 which is bent towards the bottom 9 of the U-shaped opening 6 and holds the reinforcement bar 10 resiliently against the bottom 9 of the U-shaped opening 6**.

The holding part 26 and the spring tongue **11*b* can move away towards the side when the holder 3 is placed on the reinforcement bar 10** so that the handling of the spacer is in no way impaired.

Figures 6, 7:
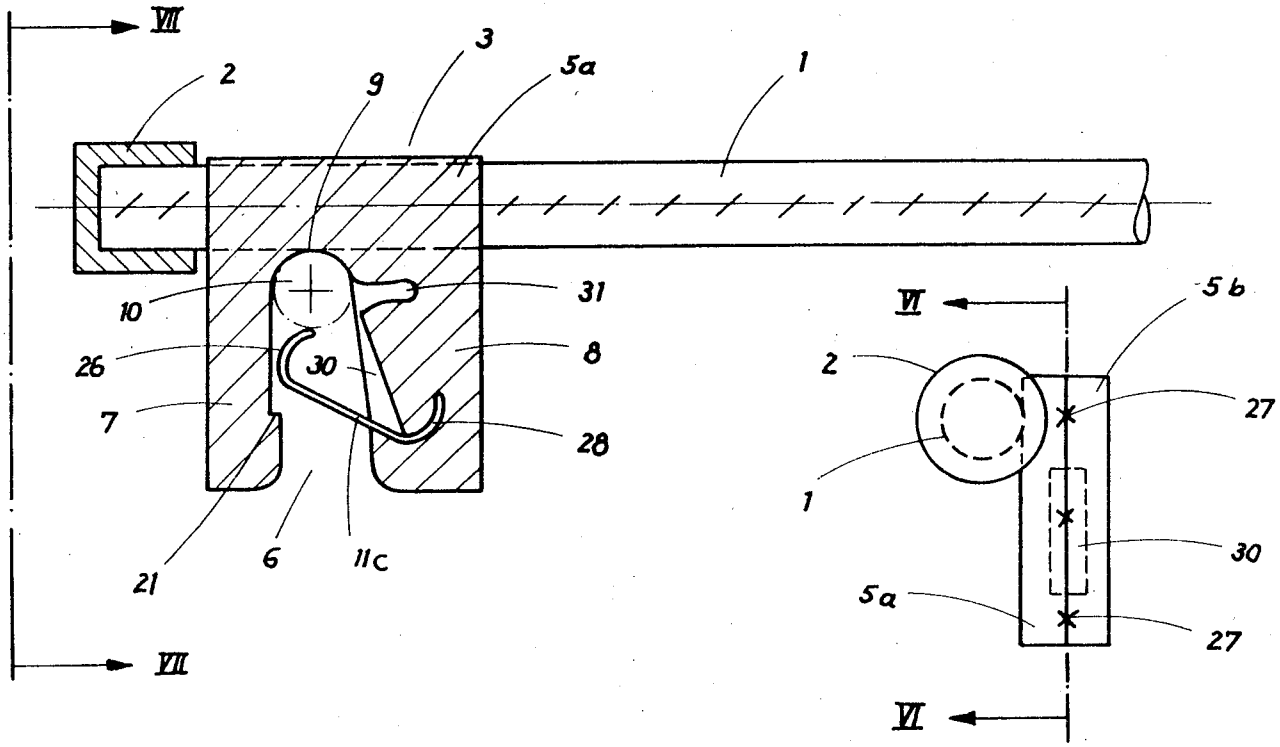
FIG. 6 shows a fourth embodiment of a spacer in accordance with the invention in a partial view, in section along the line VI—VI of FIG. 7 in side view.
FIG. 7 shows the spacer of FIG. 6 in an end view corresponding to the lines VII—VII of FIG. 6

In FIGS. 6 and 7 finally there is shown still another embodiment of the new spacer, the plate 5 consisting here of two mirror-image plate parts **5*a*, 5*b*, which rest with their wide sides against each other and are connected together at 27 by spot welding. Between the two plate parts 5*a*, 5*b* a spring tongue 11*c* which consists of round-wire material and has a bent end 28 is anchored in the region of the end of the leg 8. The spring tongue 11*c* extends into the U-shaped opening 6 in the manner which can be noted from FIG. 6; it bears a holding portion 26 which is bent towards the bottom 9 of the U-shaped opening 6 and in the manner already described with reference to FIG. 5 holds the reinforcement bar 10 resting against the bottom 9 of the opening 6. On the opposite leg 7 there is again provided a nose 21 which can support the spring tongue 11*c*** in blocking direction.

Between the two plate parts **5*a*, 5*b* there is defined a niche-like recess 30** which is directed towards the U-shaped opening 6 and which, upon the placing of the holder 3 onto the reinforcement bar 10, receives the spring tongue 11*c* which moves away to the side, the holding portion 26 thereof entering into a correspondingly deep portion 31 of the recess 30.

In particular, the embodiment of FIGS. 5 and 6 is intended for heavier reinforcement bars 10. In order to give an idea of the order of dimensions of the plate 5, it may be mentioned that, for a diameter of the reinforcement bar 10 of about 10 mm, the plate 5 is about 30 to 45 mm long in the longitudinal direction of the spacer bar 1 and—at right angles thereto—about 30 to 60 mm or more in height. The thickness of the plate may, for instance, be between 4 and 6 mm but, of course, other dimensions are also possible, depending on the stresses which are to be expected in each case.

I claim:

1. A spacer adapted for use with two reinforcement mats of a framework, each of said mats being made of an array of reinforcement bars defining a vertical plane, said spacer comprising a spacer bar adapted to be positioned perpendicularly to said two reinforcement mats, at least one substantially flat U-shaped clamp having a base secured coplanarly to said spacer bar, having two legs and an opening defined between said two legs, said opening extending from said base to free ends of said legs, spring means secured at one end thereof to one of said legs and extending into the opening so as to close the opening in a normal position of the spring means, said spring means for being elastically moveable so as to open said opening permitting one of said reinforcement bars to enter said opening upon pressing of an intermediate portion of said one reinforcement bar against said spring means in a direction towards said base such that said spring means deflects and said one reinforcement bar passes said spring means into said opening, said spring means further for returning back into said normal position closing said opening after said one reinforcement bar passes said spring means into said opening such that said clamp is held undetachably on said one reinforcement bar.

2. The spacer as set forth in claim 1, wherein two of said clamps are secured adjacent respective ends of said spacer bar.

3. The spacer as set forth in claim 2, further comprising a cap on said ends of said spacer bar adjacent said respective clamps.

4. The spacer as set forth in claim 3, further comprising a cap on an end of said spacer bar adjacent said clamp.

5. The spacer as set forth in claim 1, wherein said clamp is disposed on said spacer bar with said free ends of said legs pointing downwardly.

6. The spacer as set forth in claim 1, wherein said spring means is a leaf spring having a free end adjacent said other leg.

7. The spacer as set forth in claim 6, wherein said spring means extends into said opening obliquely towards said base and is engageable with said free and against said other leg.

8. The spacer as set forth in claim 1, wherein said other leg includes a stop facing said base, spring means is a spring tongue having a free end, said free end of said spring tongue is engageable against said stop in said normal position of said spring means.

9. The spacer as set forth in claim 1, wherein said opening extends to adjacent said spacer bar.

10. The spacer as set forth in claim 1, wherein said opening adjacent said base has a cross-section equal to substantially half of the periphery of said one reinforcement bar.

11. The spacer as set forth in claim 1, wherein said legs have surfaces facing each other defining said opening therebetween, said surfaces substantially diverge relative each other in a direction from said base to said free ends of said legs.

12. The spacer as set forth in claim 11, wherein said surfaces adjacent said free ends are rounded convexly viewed in a direction toward said base.

13. The spacer as set forth in claim 11, wherein one of said surfaces on said other leg is substantially vertical and forms a stop facing said base engageable with said spring means in a blocking position.

14. The spacer as set forth in claim 1, wherein said one leg is formed with a continuous hole extending completely therethrough in a direction parallel to said spacer bar when in said opening and a slot communicating with said continuous hole, said one end of said spring means forms a cylindrically rolled end portion non-detachably anchored in said hole, said spring means extending therefrom through said slot into said opening.

15. The spacer as set forth in claim 14, wherein an edge of said slot is rounded toward said base.

16. The spacer as set forth in claim 14, wherein said one leg has indentations holding said one end of said spring means axially in said continuous hole.

17. The spacer as set forth in claim 1, wherein said spacer bar is secured along said base from said one leg to the other leg and perpendicular to said legs.

18. The spacer as set forth in claim 1, wherein said base has a curvature portion complementary to a portion of the periphery of said spacer bar, said spacer bar being secured to said base in said curvature portion.

19. The spacer as set forth in claim 1, wherein said clamp and said spacer bar are made of steel and are welded together.

20. The spacer as set forth in claim 1, wherein said spacer bar is straight and is made of steel.

21. The spacer according to claim 1, wherein the spring means is formed as a wire spring.

22. The spacer according to claim 21, wherein said clamp is formed of a plate comprising two mirror-image plate parts which are attached together with wide sides thereof against each other, said wire spring is held between said plate parts, and said plate parts at said one leg define a notch-like recess which opens into said opening, and said wire spring is bent laterally and releasably extends into said notch-like recess when said spring means is deflected upon said pressing of the intermediate portion of said one reinforcement bar against said spring means in a direction towards said base.

23. The spacer according to claim 1, wherein the spring means comprises a leaf spring formed as a bending portion of a spring-plate part, the latter having holding parts formed thereon, said holding parts being fastened to said one leg of the clamp.

24. The spacer according to claim 1, wherein the spring means has a holding portion which is bent towards the base of said clamp and holds said one reinforcement bar against the base.

25. The spacer according to claim 24, wherein said spring means is formed by one side portion of a strip of spring material which is bent into approximately triangular shape and has a base portion, another side portion of said strip comprises the holding portion, said one leg of the clamp is formed with a holding opening, and said base portion is inserted into said holding opening, said holding opening surrounding said base portion on both sides.

* * * * *